US006579074B2

(12) United States Patent
Chiba

(10) Patent No.: US 6,579,074 B2
(45) Date of Patent: Jun. 17, 2003

(54) DIAPHRAGM TYPE FUEL PUMP

(75) Inventor: Noriaki Chiba, Morioka (JP)

(73) Assignee: Mikuni Adec Corporation, Iwate-gun (JP)

( * ) Notice: Subject to any disclaimer, the term of this patent is extended or adjusted under 35 U.S.C. 154(b) by 0 days.

(21) Appl. No.: 09/988,611

(22) Filed: Nov. 20, 2001

(65) Prior Publication Data

US 2002/0085928 A1 Jul. 4, 2002

(30) Foreign Application Priority Data

Dec. 28, 2000 (JP) ..... 2000-401706

(51) Int. Cl.[7] ..... F04B 45/053; F04B 49/24
(52) U.S. Cl. ..... 417/307; 417/395
(58) Field of Search ..... 417/307, 395

(56) References Cited

U.S. PATENT DOCUMENTS 1,848,546 A * 3/1932 Redmond ..... 417/307
2,146,398 A * 2/1939 Lafferty ..... 417/307
2,405,466 A * 8/1946 Tabb ..... 417/307
2,942,550 A * 6/1960 Carter ..... 417/307
3,386,388 A * 6/1968 Rosenberg ..... 417/395
4,807,573 A * 2/1989 Schierling et al. ..... 417/395
6,340,294 B1 * 1/2002 Kubota et al. ..... 417/395

FOREIGN PATENT DOCUMENTS

JP 11-201043 7/1999

* cited by examiner

*Primary Examiner*—Michael Koczo
(74) *Attorney, Agent, or Firm*—Oblon, Spivak, McClelland, Maier & Neustadt, P.C.

(57) ABSTRACT

In order to provide a diaphragm type fuel pump which is compact and assures a stable operation, a cavity is formed in a pump body at a position where the pump body is in contact with a fuel discharge chamber. The cavity is arranged between outer and inner parts of the pump body and perpendicularly extends to a diaphragm. The pump body has a return path communicating with a fuel intake chamber and the cavity via opposite ends thereof. A pressure regulating mechanism is housed in the cavity using a cap attached to the pump body, and is positioned inside an outer diameter of a pump chamber. This prevents the pressure regulating chamber from projecting out of the pump chamber contrary to a pressure regulating chamber of the related art, and makes the fuel pump compact. A valve seat is formed in the cap which is separate from the pump body. This facilitates machining of the valve seat.

5 Claims, 11 Drawing Sheets

DIAPHRAGM TYPE FUEL PUMP

BACKGROUND OF THE INVENTION

1. Field Of The Invention

The present invention relates to a diaphragm type fuel pump in which fuel is introduced and discharged in accordance with strokes of a diaphragm.

2. Description Of Related Art

A diaphragm type fuel pump has been used up to now in order to introduce fuel into a fuel injector from a fuel tank. In the fuel pump, a diaphragm is operated using pulsating pressure of an engine in order to introduce and discharge fuel. Depending on the type of engine, fuel discharge pressure can sometimes become too large. Therefore, there are some diaphragm type fuel pumps provided with a fuel pressure regulating mechanism.

Japanese Patent Laid-Open No. Hei 11-201043 discloses a diaphragm type fuel pump including a fuel pressure regulating mechanism. Referring to FIG. 9 of the accompanying drawing figures, a fuel pump 70 includes: a fuel intake chamber 71; a fuel discharge chamber 72; a pump chamber 73; a fuel intake path 74 for introducing fuel from a fuel tank (not shown) to the fuel intake chamber 71; and a fuel discharge path 75 for discharging fuel to a fuel injector and or the like (not shown). Further, a fuel pressure regulating mechanism 76 is provided in the fuel discharge chamber 72. A fuel return pipe 77 connects the fuel pressure regulating mechanism 76 and the fuel intake chamber 71. The pressure regulating mechanism 76 is positioned outside the fuel pump 70, and returns the fuel from the fuel discharge chamber 72 to the fuel intake chamber 71 via the fuel return pipe 77 whenever the fuel pressure in the fuel discharge chamber 72 exceeds a predetermined value.

FIGS. 10 and 11 show a diaphragm type fuel pump 80 including a fuel pressure regulating mechanism (i.e., constituted of spill valve 96 and spring 98) which is structurally different from the fuel pressure regulating mechanism 76 of the fuel pump 70 shown in FIG. 9. A body 81 of the fuel pump 80 includes a partition wall 82, which defines, together with a diaphragm 84, a fuel intake chamber 86 and a fuel discharge chamber 88. Fuel is introduced into the fuel intake chamber 86 via a fuel intake path 90, and is discharged from the fuel discharge chamber 88 via a fuel discharge path 92. A path 94 is formed in the partition wall 82 in order to connect the fuel intake chamber 86 and the fuel discharge chamber 88. A spill valve (ball valve) 96 and a spring 98 are provided in the fuel intake chamber 86 in order to open and close the path 94.

Further, a cylindrical guide 99 is provided in the fuel intake chamber 86 in order that the spill valve 96 and the spring 98 move in a predetermined axial direction. The fuel intake path 90, fuel discharge path 92, path 94 and cylindrical guide 99 are substantially coaxial. A valve seat 100 is positioned at one end of the path 94 which is formed in the partition wall 82 and opens to the fuel intake chamber 86.

When a pressure in the fuel discharge chamber 88 is equal or less than the predetermined value, the spill valve 96 is pushed by the spring 98, sits on the valve seat 100 and closes the path 94, so that no fuel is returned to the fuel intake chamber 86 from the fuel discharge chamber 88. Otherwise, the pressure larger than the predetermined value pushes the spill valve 96 toward the fuel intake chamber 86 against the spring 98 and the pressure in the fuel intake chamber 86, thereby opening the path 94. Therefore, the high pressure fuel in the fuel discharge chamber 88 is returned to the fuel intake chamber 86, thus regulating the pressure of the fuel discharged via the fuel discharge path 92.

In the fuel pump shown in FIG. 9, the fuel pressure regulating mechanism 76 is arranged further out than the outer diameter D of the pump chamber 73 (shown by a dashed circle), which means that the fuel pump 70 is enlarged and becomes heavy because of the pressure regulating mechanism 76, and there is a problem related to fitting of the fuel pump 70.

Further, the fuel pump 70 should be provided with a fuel return pipe 77 running over an exterior thereof, which would lead to an increase in the cost of the fuel pump 70 and a problem of fitting.

In the diaphragm type fuel pump 80 of FIGS. 10 and 11, the fuel pressure regulating mechanism constituted by the spill valve 96 and the spring 98 is housed in the fuel intake chamber 86, which is effective in making the fuel pump 80 compact.

However, this fuel pump seems to suffer from the following three problems.

(1) Since the valve seat 100 at the opening of the path 94 near the fuel intake chamber 86 is positioned behind the cylindrical guide 99, the valve seat 100 is far from the fuel intake path 90 in the body 81, which makes it difficult to perform surface treatment of the valve seat 100 and to check plane accuracy thereof.

(2) Both the fuel intake path 90 and the path 94 are linearly positioned with the spill valve 96 interposed therebetween. Fuel flowing through the fuel intake path 90 and fuel flowing through the path 94 may adversely affect the operation of the spill valve 96, or may interfere with each other.

(3) The spring 98 may become long depending upon a mounting structure, which would cause variations in the dimensions of the spring 98. This would lead to varying performances of the spring 98.

Because of the above-described problems with respect to the fuel pressure regulating mechanisms of the foregoing fuel pumps 70 and 80, it is difficult to have the fuel pumps 70 and 80 function as desired and assure reliable performance.

SUMMARY OF THE INVENTION

The invention is devised in order to overcome the foregoing problems of the related art, and provides a compact diaphragm type fuel pump whose performance is reliable.

In order to accomplish the foregoing objects of the present invention, a diaphragm type fuel pump is provided which comprises; a fuel intake chamber; a fuel discharge chamber; a pump body; a diaphragm; a pump chamber; a return path; and a pressure control mechanism. The pump body has a fuel intake path communicating with the fuel intake chamber and a fuel discharge path communicating with the fuel discharge chamber. The diaphragm is fixedly attached to the pump body via a bottom body. The pump chamber is defined by the diaphragm and the pump body and communicates with the fuel intake path and the fuel discharge path. The return path connects the fuel intake chamber and the fuel discharge chamber. The pressure control mechanism is for returning fuel from the fuel discharge chamber to the fuel intake chamber via the return path when pressure in the fuel discharge chamber exceeds a predetermined value. The return path is formed in the pump body. A cavity is formed between outer and inner parts of the pump body, communicates with the return path via one end thereof and with the fuel intake or discharge chamber via the other end thereof and perpendicularly extends to the diaphragm. The pressure regulating mechanism is housed in the cavity, and is positioned inside an outer diameter of the pump chamber.

DETAILED DESCRIPTION OF THE PREFERRED EMBODIMENTS

First Embodiment

Figure 1:
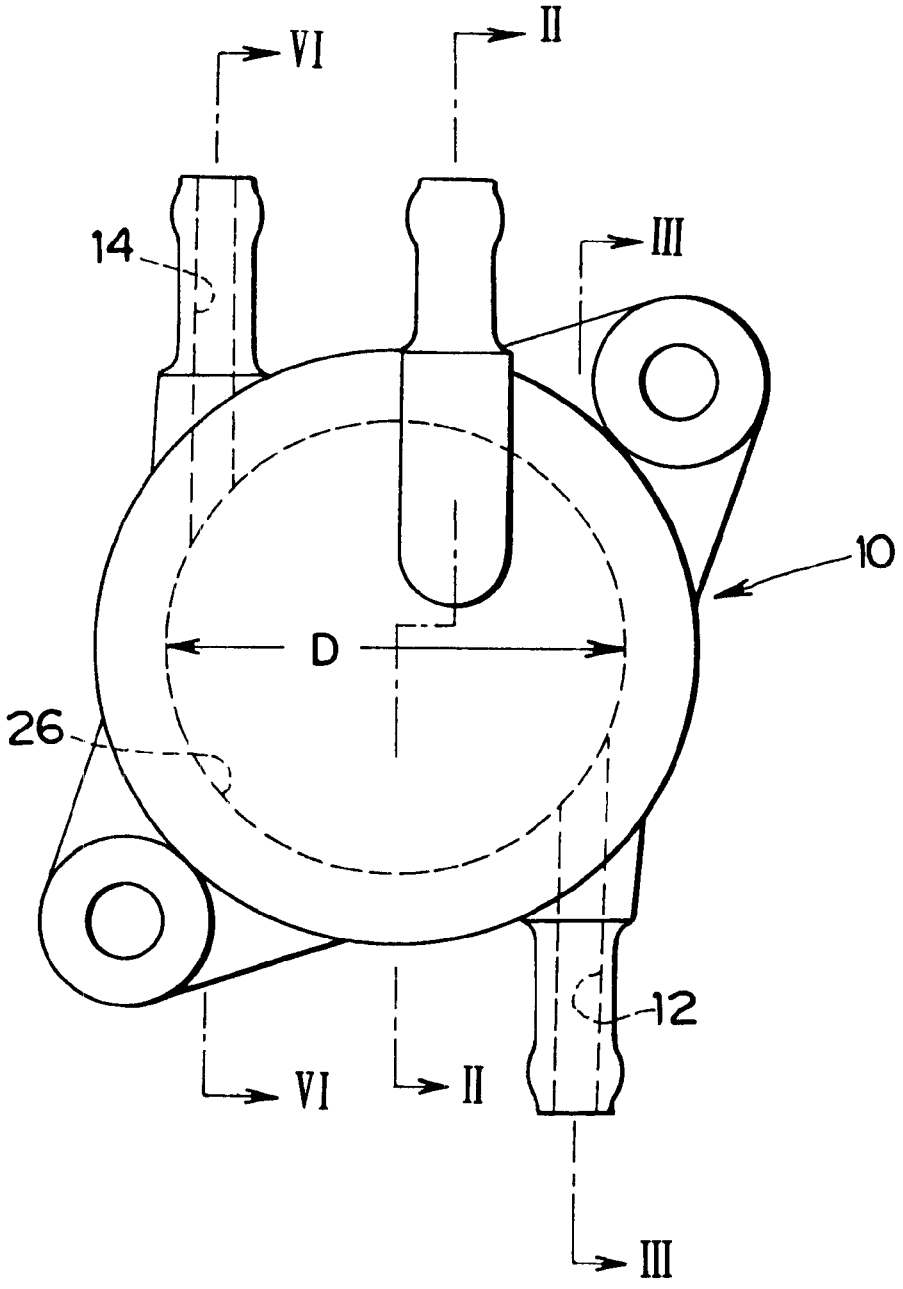
FIG. 1 is a top plan view of a diaphragm type fuel pump according to the first embodiment of the invention.
Figure 2:
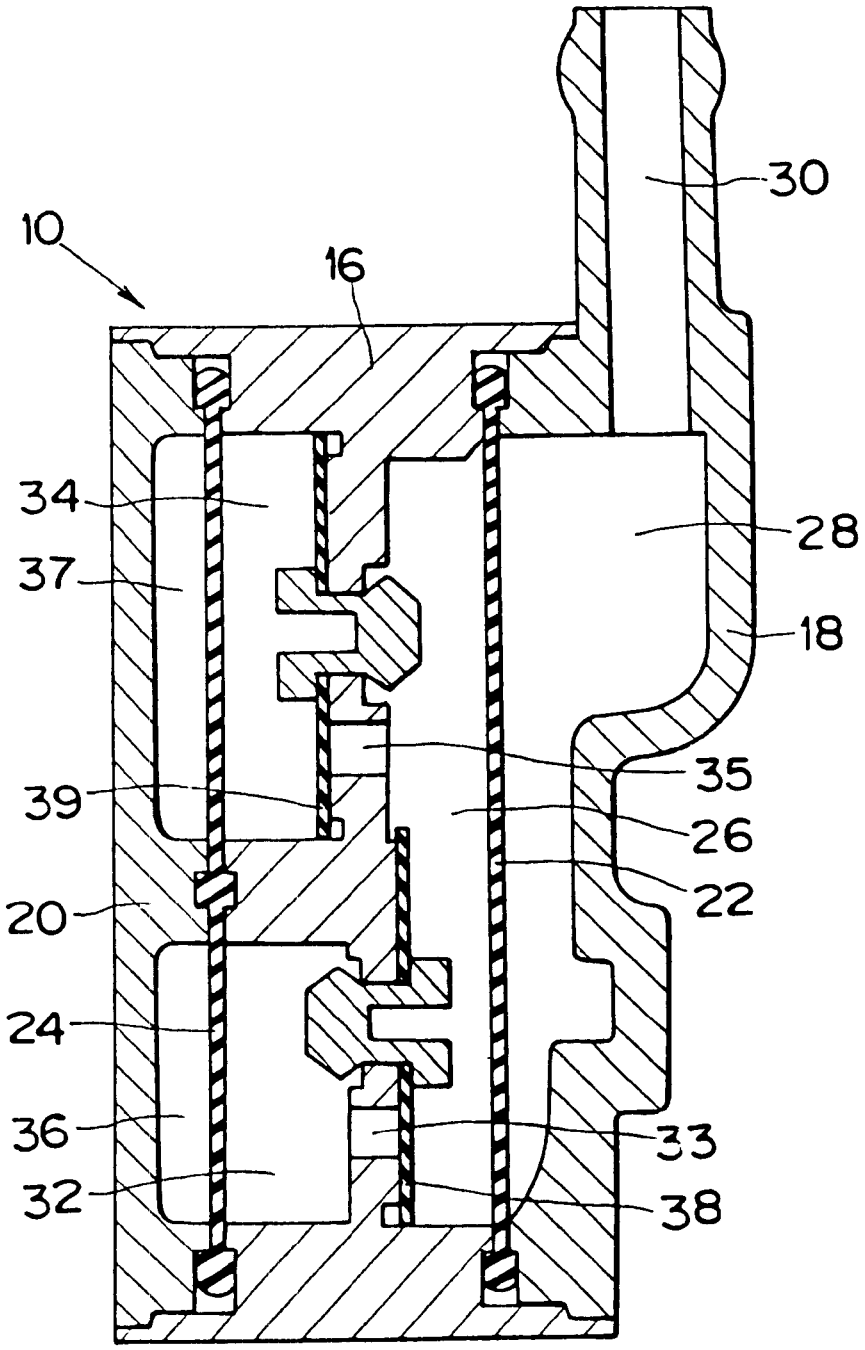
FIG. 2 a cross section of the fuel pump taken along line II—II shown in FIG. 1.

The invention will be described with reference to a first embodiment shown in the accompanying drawings. FIG. 1 is a top plan view of a diaphragm type fuel pump 10, and FIG. 2 is a cross section of the fuel pump taken along line II—II in FIG. 2.

The diaphragm type fuel pump 10 includes: a pump body 16 formed with a fuel intake path 12 and a fuel discharge path 14; a bottom body 18 positioned at one side of the pump body 16; a cover 20 at the other side of the pump body 16; a diaphragm 22 sandwiched between the pump body 16 and the bottom body 18; and a membrane 24 sandwiched between the pump body 16 and the cover 20. The pump body 16 and the bottom body 18 are usually made of metal or synthetic resin. The diaphragm 22 and the membrane are usually made of a rubber material or synthetic resin, but may be made of any other material.

A pump chamber 26 15 provided between the diaphragm 22 and the pump body 16, and a pulse chamber 28 is provided between the diaphragm 22 and the bottom body 18. The bottom body 18 includes a pulse introducing path 30 which introduces a pulse pressure into the pulse chamber 28. The pulse pressure is generated by an engine.

A fuel intake chamber 32 and a fuel discharge chamber 34 are defined between the membrane 24 and the pump body 16. A damper chamber 36 and a damper chamber 37 are formed between the membrane 24 and the cover 20. The damper chambers 36 and 37 face with the fuel intake chamber 32 via the membrane 24, respectively. The fuel intake chamber 32 communicates with the pump chamber 26 via an intake path 33 in the pump body 16 while the fuel discharge chamber 34 communicates with the pump chamber 26 via a discharge path 35 in the pump body 16. The intake path 33 is opened and closed by a check valve 38 in order to carry the fuel only to the pump chamber 26 from the fuel intake chamber 32. On the other hand, the discharge path 35 is opened and closed by a check valve 39 in order to carry the fuel only to the fuel discharge chamber 34 from the pump chamber 26 includes a pulse introducing path 30 which introduces a pulse pressure into the pulse chamber 28. The pulse pressure is generated by an engine.

In the fuel pump 10, the pulse pressure generated in a crank chamber (not shown) is introduced into the pulse chamber 28, so that the diaphragm 22 alternately moves on each stroke toward the pump chamber 26 and the pulse chamber 28. The stroke motion of the diaphragm 22 enables the fuel to be discharged to a fuel injector from the pump chamber 26 via the fuel discharge chamber 34. The fuel is introduced into the fuel intake chamber 32 from a fuel tank (not shown). The structure shown in FIG. 2 is well-known.

Figure 3:
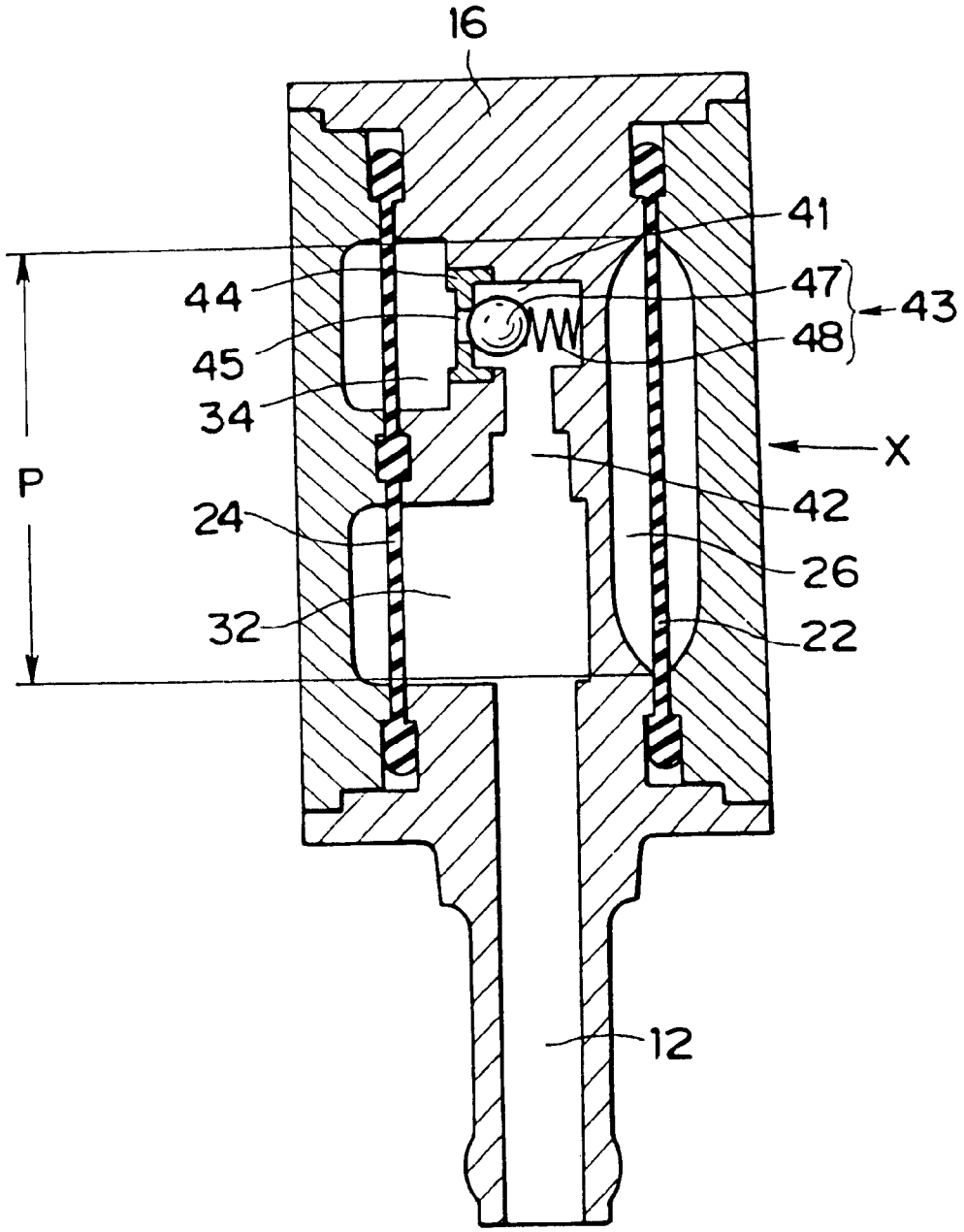
FIG. 3 is a cross section of the fuel pump taken along line III—III shown in FIG. 1.
Figure 4:
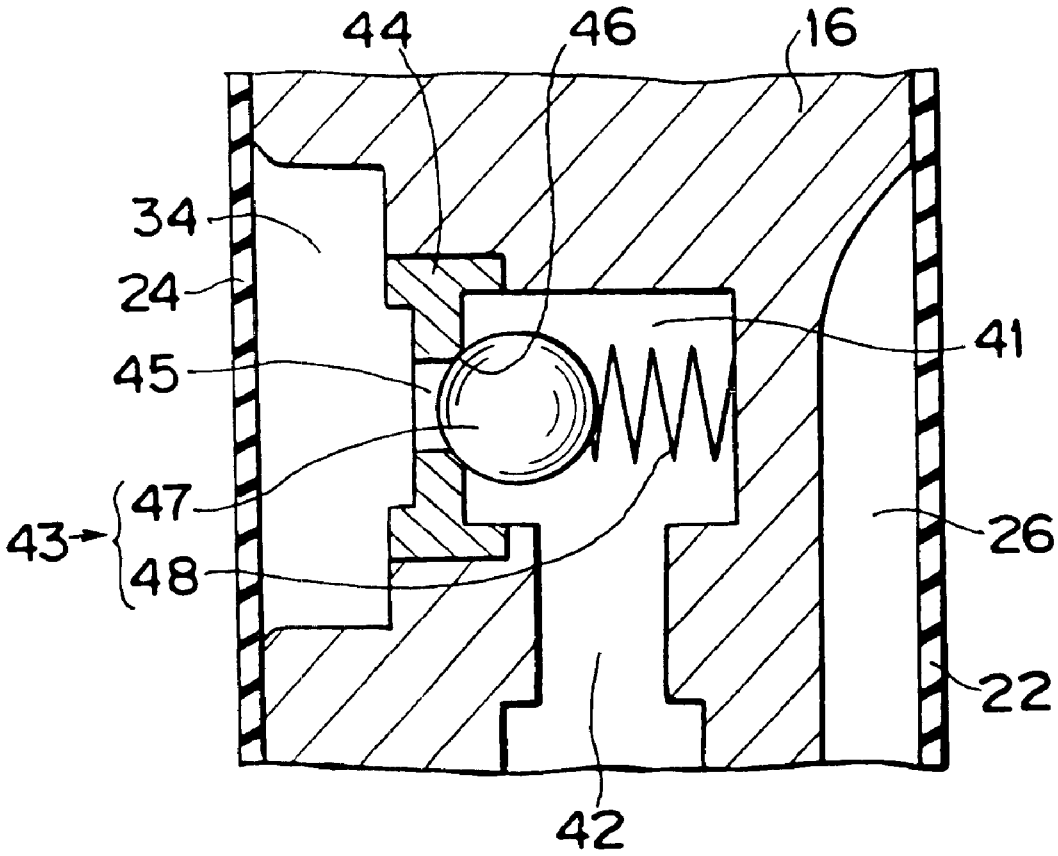
FIG. 4 is an enlarged cross section of the essential parts of the fuel pump.

FIG. 3 is a cross section of the fuel pump 10 taken along line III—III in FIG. 1. FIG. 4 is an enlarged cross section of the essential parts shown in FIG. 3. The fuel pump 10 of this embodiment includes the structure shown in these drawing figures.

Referring to FIG. 3, the pump body 16 is provided with a fuel intake path 12 communicating with the fuel intake chamber 32 and the fuel tank via opposite ends thereof. Further, the pump body 16 has a cavity 41 which is formed between outer and inner parts of the pump body 16, and perpendicularly extends to the diaphragm 22 and opens to the fuel discharge chamber 34. Still further, the pump body 16 has a return path 42 which communicates with the fuel intake chamber 32 and the cavity 41 via opposite ends thereof. A pressure regulating mechanism 43 is housed in the cavity 41 using a cap 44 attached to the pump body 16.

The pressure regulating mechanism 43 is positioned inside an outer diameter D of the pump chamber 26 as shown in FIG. 1, i.e. inside an effective diameter P of the pump chamber 26 when viewed in the direction X shown in FIG. 3.

The cap 44 has a path 45 connecting the fuel discharge chamber 34 and the cavity 41. A valve seat 46 is formed at an open end of the path 45 near the cavity 41. The pressure regulating mechanism 43 is constituted by a spill valve (ball valve) 47 which comes into contact with the valve seat 46, and a spring 48 which urges the spill valve 47 to be brought into contact with the valve seat 46 of the cap 44. However, the pressure regulating mechanism 43 may be constituted by any other components. When the spring 48 and the spill valve 47 are housed in the cavity 41 and when the cap 44 is attached to the open end of the cavity 41, the spill valve 47 remains on the valve seat 46.

When a fuel pressure in the fuel discharge chamber 34 is equal to or lower than a predetermined value, the spill valve 47 is made to sit on the valve seat 46 by the spring 48, thereby closing the path 45. In this state, no fuel in the fuel discharge chamber 34 is introduced into the return path 42.

Conversely, the fuel pressure above the predetermined value pushes the spill valve 47 toward the spring 48 against its resiliency, so that the path 45 is opened. Therefore, some of the fuel in the fuel discharge chamber 34 is returned to the fuel intake chamber 32 via the cavity 41 and the return path 42, thereby regulating the pressure of the fuel to be discharged.

In the invention, the cap 44 having the path 45 and the valve seat 46 is separate from the pump body 16, which facilitates machining of the valve seat 46 and stabilizes the operation of the fuel pump.

Figure 9:
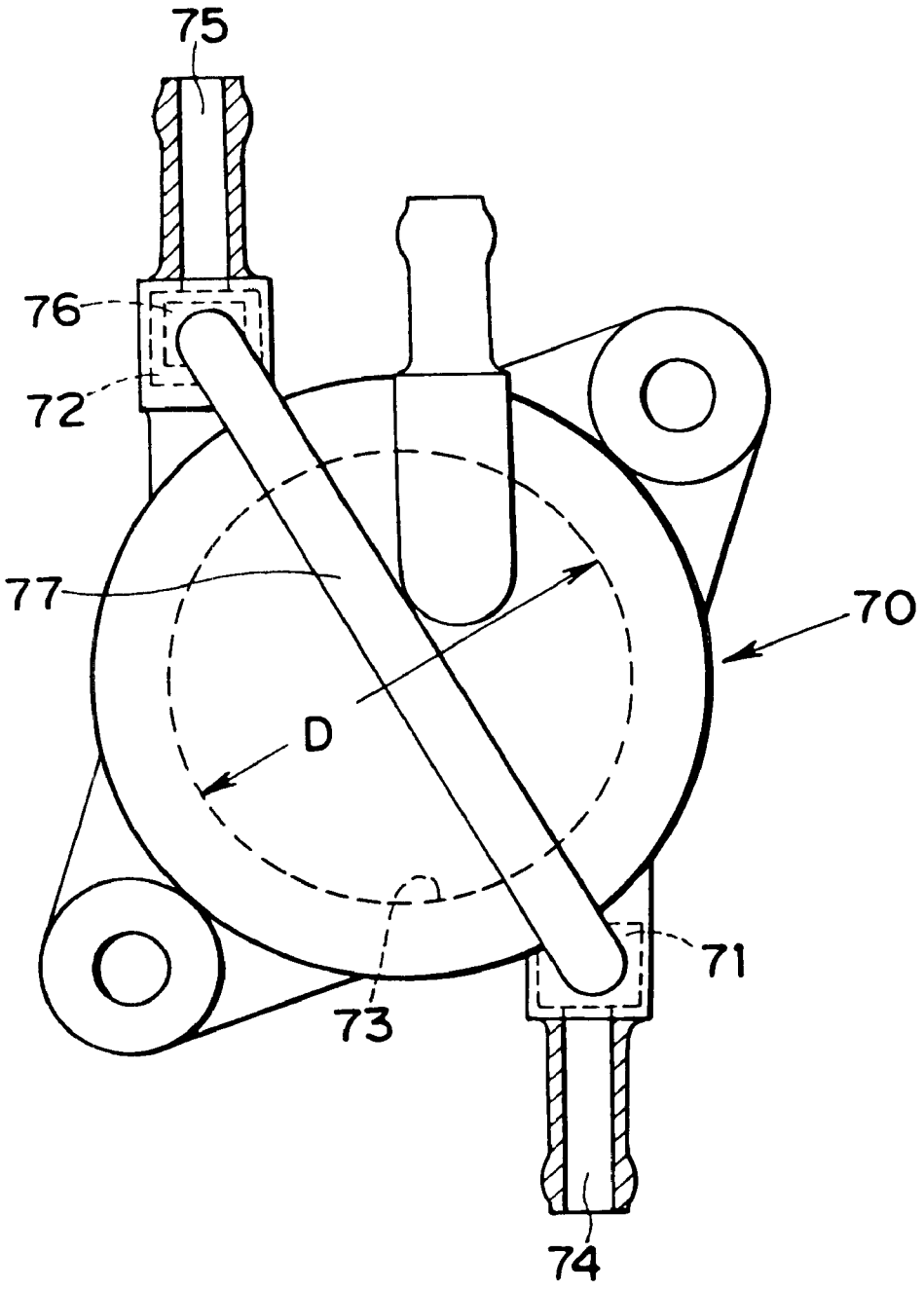
FIG.9 RELATED ART
FIG. 9 is a top plan view of a diaphragm type fuel pump of the related art.
Figure 10:
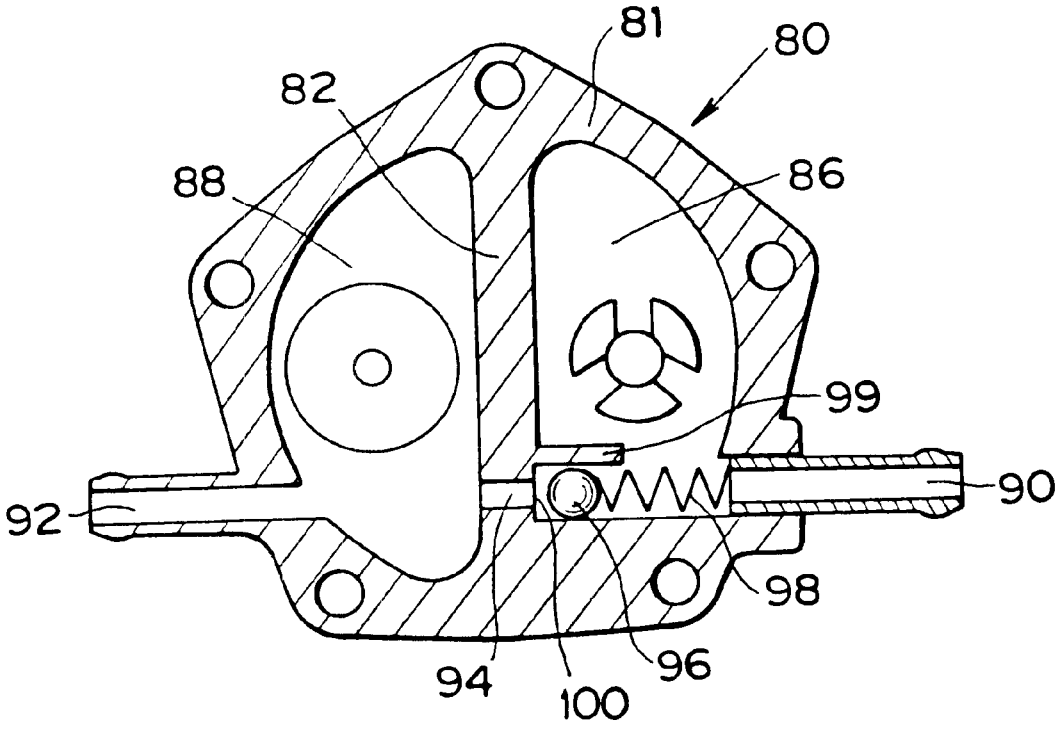
FIG.10 RELATED ART
FIG. 10 is a cross section of another diaphragm type fuel pump of the related art.
Figure 11:
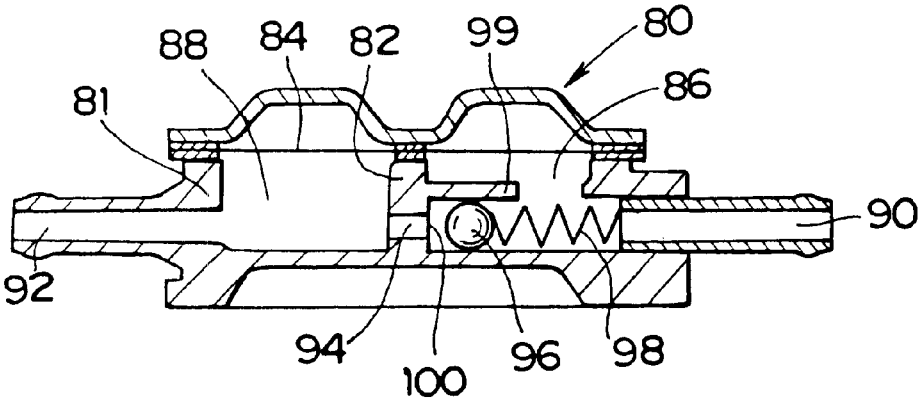
FIG.11 RELATED ART
FIG. 11 is a cross section of the diaphragm type fuel pump of FIG. 10.

Further, the pressure regulating mechanism 43 is positioned inside the outer diameter D of the pump body 26, and does not project from the fuel pump as shown in FIGS. 1 and 3 when compared with the pressure regulating mechanism of the related art shown in FIG. 9. Therefore, the fuel pump can be made compact.

Second Embodiment

Figure 5:
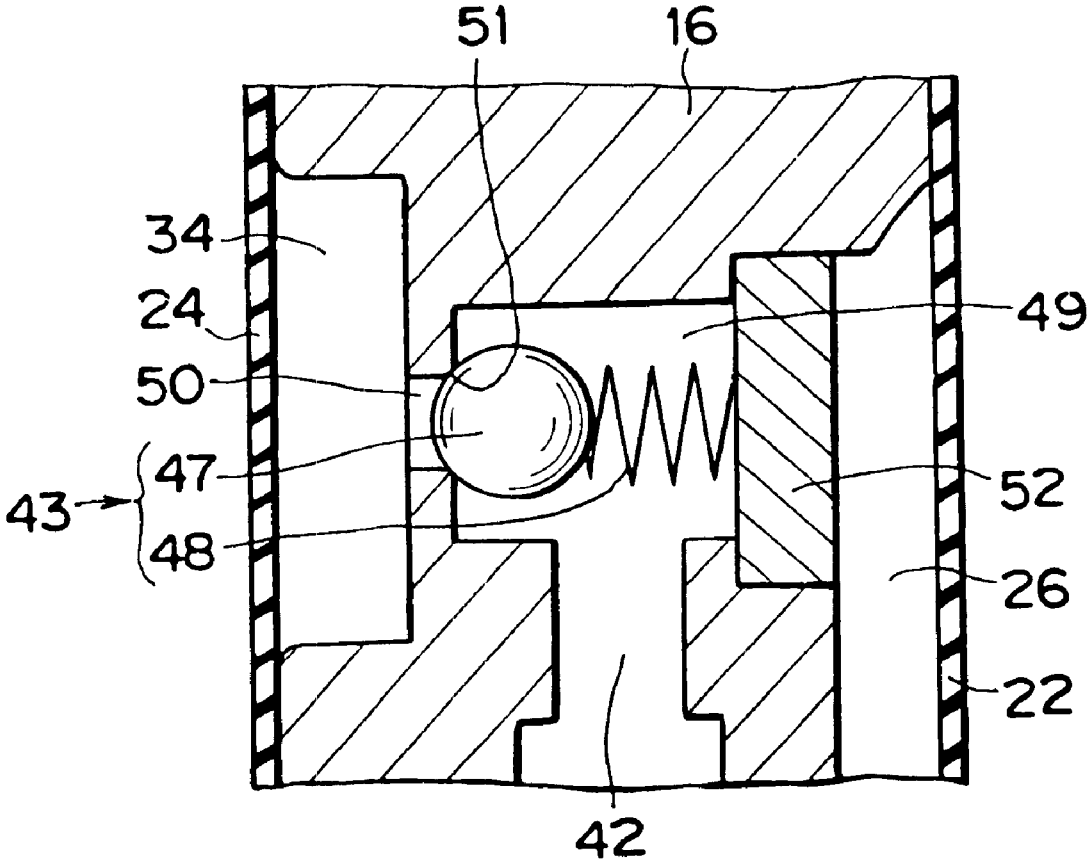
FIG. 5 is similar to FIG. 4, showing a fuel pump of a second embodiment.

A second embodiment of the fuel pump shown in FIGS. 3 and 4 is shown in FIG. 5, in which parts corresponding to those in FIGS. 3 and 4 are denoted by corresponding reference numerals. A cavity 49 is formed between outer and inner sides of a pump body 16, opens to a pump chamber 26, and perpendicularly extends to a diaphragm 22. The cavity 49 communicates with a return path 42, and with a fuel discharge chamber 34 via a path 50 formed in the pump body 16. A valve seat 51 is formed at an open end of the path 50 near the cavity 49. A pressure regulating mechanism 43 constituted by a spill valve 47 and a spring 48, for example, is housed in the cavity 49 using a cap 52 attached to the pump body 16. Referring to FIG. 5, the spill valve 47 and the spring 48 are sequentially inserted into the cavity 49 via an open end of the pump chamber 26. The spill valve 47 sits on the valve seat 51 once the cap 52 is attached to the open end of the cavity 49.

In the second embodiment, the pressure regulating mechanism 43 is positioned inside the diameter D of the pump chamber 26 shown in FIG. 1.

Referring to FIG. 5, the cavity 49 opens to the pump chamber 26, which facilitates machining of the valve seat 51 via the open end of the cavity 49, and stabilizes the operation of the fuel pump.

The pressure regulating chamber 43 is positioned inside the outer diameter D of the pump chamber 26, and does not project from the fuel pump as shown in FIGS. 1 and 3 when compared with the pressure regulating mechanism shown in FIG. 9. This can make the fuel pump compact.

Third Embodiment

Figure 6:
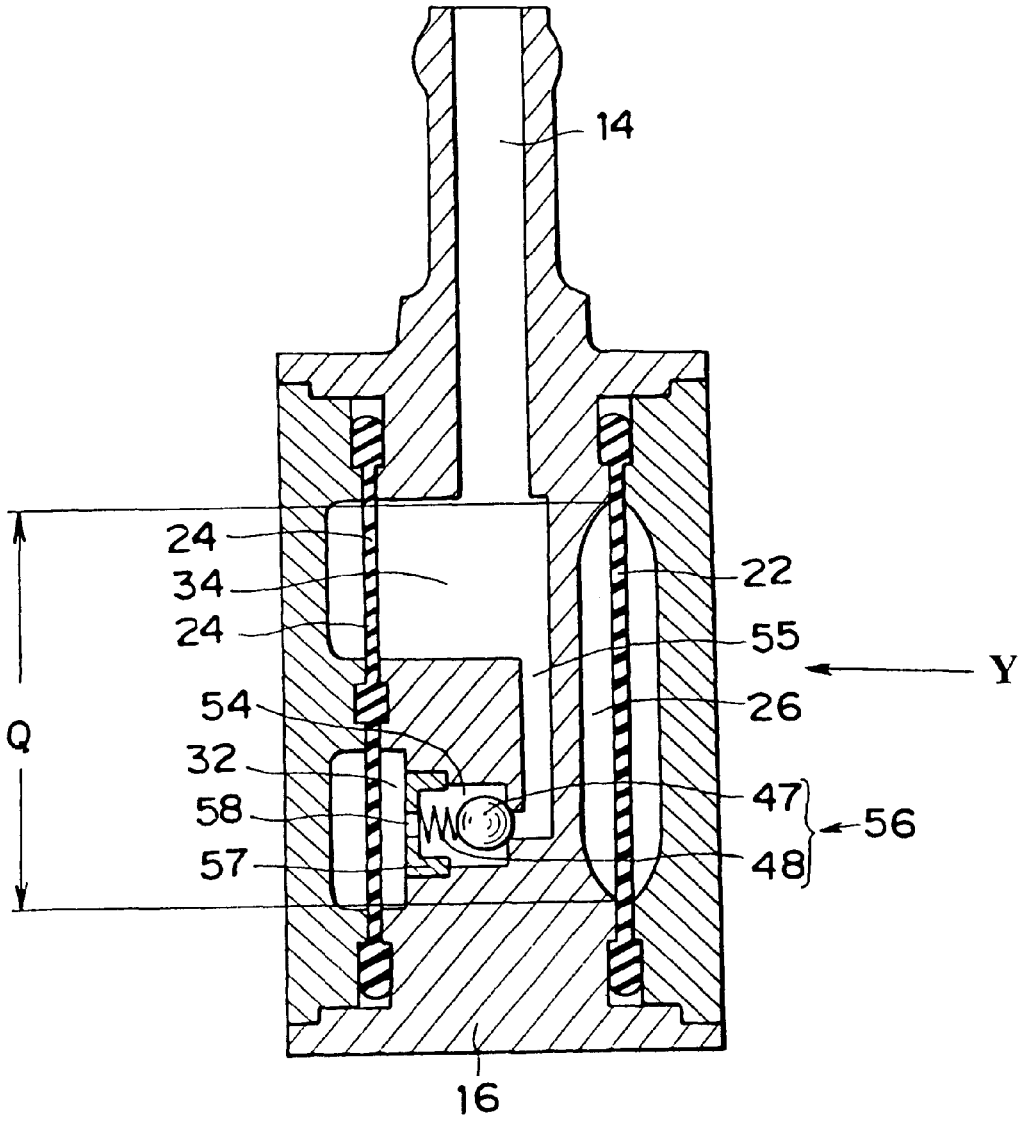
FIG. 6 is a cross section of the fuel pump taken along line VI—VI shown in FIG. 1.
Figure 7:
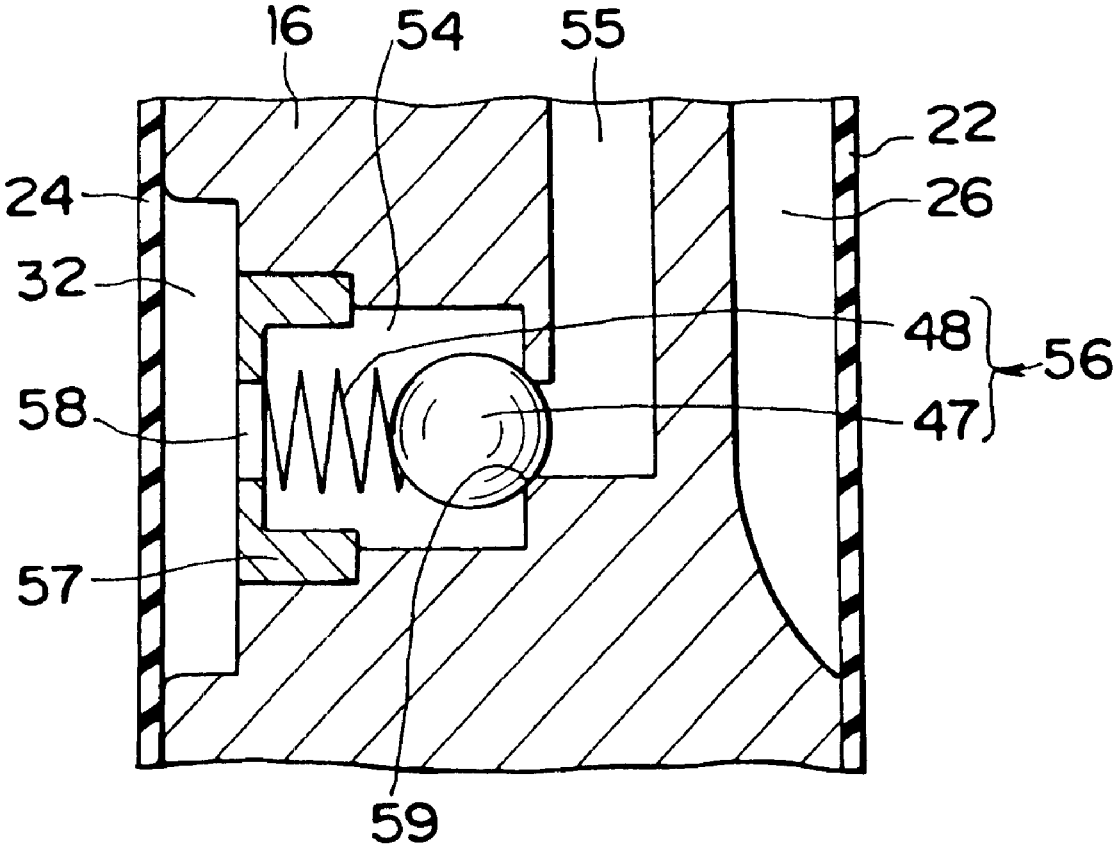
FIG. 7 is an enlarged cross section of the essential parts of the fuel pump.

In this embodiment, a fuel pump has a structure which is shown in FIGS. 6 and 7. The fuel pump may have the structure of this embodiment in place of the structures in the first and second embodiments, or may share the structures in the first to third embodiments.

Referring to FIGS. 6 and 7, a pump body 16 has a fuel discharge path 14 communicating with a fuel discharge chamber 34 and a fuel injector (not shown) via opposite ends thereof. Further, the pump body 16 has a cavity 54 which is present between outer and inner parts thereof, opens to a fuel intake chamber 32, and perpendicularly extends to a diaphragm 22. Still further, the pump body 16 is provided with a return path 55 communicating with the fuel discharge member 34 and the cavity 54 via opposite ends thereof. A pressure regulating mechanism 56 is housed in the cavity 54 using a cap 57 attached to the pump body 16.

The pressure regulating mechanism 56 is positioned inside the diameter D of the pump body 16 shown in FIG. 1, i.e. inside the effective diameter Q of the pump body 16 when viewed in the direction Y shown in FIG. 6.

The cap 57 has a path 58 connecting the fuel intake chamber 32 and the cavity 54. A valve seat 59 is formed in the pump body 16 at a position where the return path 55 connects to the cavity 54. The pressure regulating mechanism 56 is constituted by a spill valve (ball valve) 47 which comes into contact with the valve seat 59 and a spring 48 urging the spill valve 47 toward the valve seat 59. However, the pressure regulating mechanism 56 may be constituted by any other components. When the spill valve 47 and the spring 48 are housed in the cavity 54, and when the cap 57 is attached to the open end of the cavity 54, the spill valve 47 sits on the valve seat 59.

Referring to FIGS. 6 and 7, when the fuel pressure in the fuel discharge chamber 34 is equal to or less than the predetermined value, the spill valve 47 is made to sit on the valve seat 59 by the spring 48, and closes a connecting portion of the return path 55 and the cavity 54. In this state, no fuel in the fuel discharge chamber 34 is returned to the fuel intake chamber 32.

Conversely, the fuel pressure which is higher than the predetermined value in the fuel discharge chamber 34 pushes the spill valve 47 toward the spring 47 against the resiliency thereof, so that the connecting portion of the return path 55 and the cavity 54 is opened. As a result, some of the fuel in the fuel discharge chamber 34 is returned to the fuel intake chamber 32 via the return path 55 and the cavity 54, thereby regulating the pressure of the fuel to be discharged.

As shown FIGS. 6 and 7, the cavity 54 opens to the fuel intake chamber 32, which facilitates machining of the valve seat 59 via the open end of the cavity 54, and stabilizes the operation of the fuel pump.

The pressure regulating mechanism 56 is positioned inside the outer diameter D of the pump chamber 26, and does not project from the pump body as shown in FIGS. 1 and 6, so that the fuel pump can be made compact compared with the fuel pump shown in FIG. 9.

Fourth Embodiment

Figure 8:
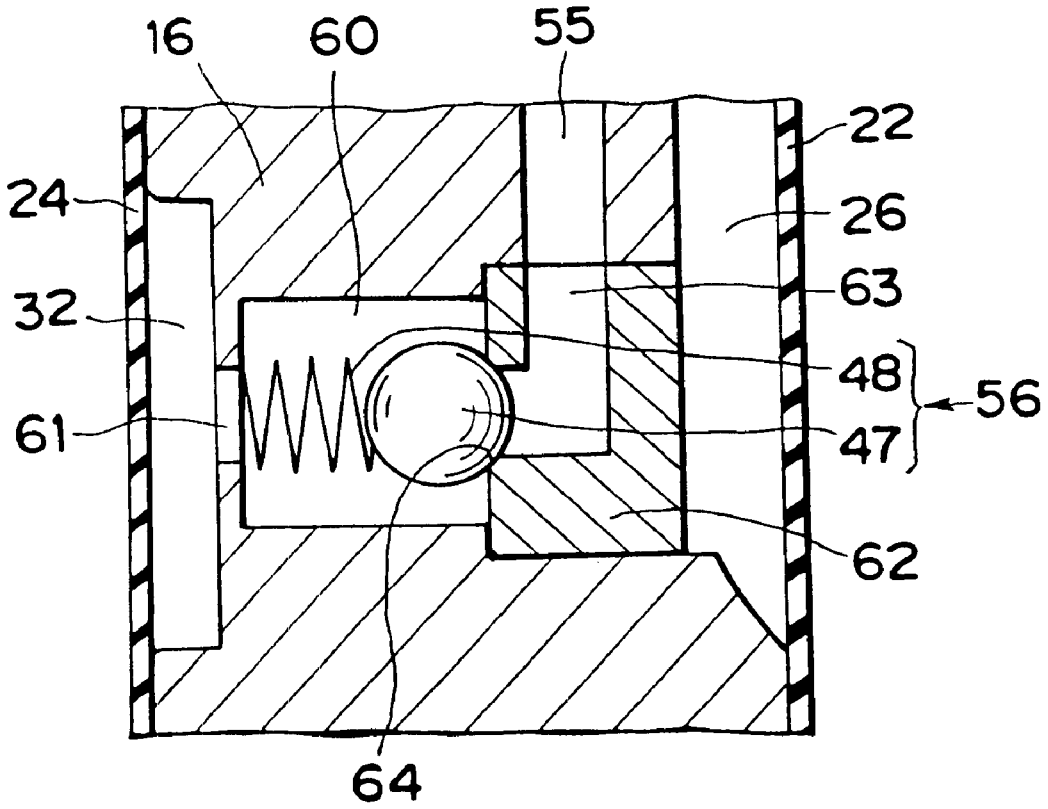
FIG. 8 is similar to FIG. 7, showing a fuel pump of a third embodiment.

FIG. 8 shows the structure of a diaphragm type fuel pump according to a fourth embodiment of the invention. In FIG. 8, parts corresponding to those in FIGS. 6 and 7 are denoted by corresponding reference numerals. A pump body 16 has a cavity 60 which is present between outer and inner parts thereof, and perpendicularly extends to a diaphragm 22. The cavity 60 opens to a pump chamber 26, and communicates with a return path 55. Further, the cavity 60 communicates with a fuel intake chamber 32 via a path 61 formed in the pump body 16. A pressure regulating mechanism 56 including a spill valve 47 and a spring 48, for example, is housed in the cavity 60 using a cap 62 attached to the pump body 16. The pressure regulating mechanism 56 is positioned inside the diameter D of the pump chamber 26. A path 63 is formed in the cap 62, and communicates with the return path 55 and a path 63 via opposite ends thereof. A valve seat 64 is provided at an open end of the path 63 near the cavity 60.

Referring to FIG. 8, the spring 48 and spill valve 47 are inserted into the cavity 60 via the open end of the pump chamber 26 in the named order, and then the cap 62 is attached to the open end of the cavity 60. In this state, the spill valve 47 sits on the valve seat 64.

In the fourth embodiment shown in FIG. 8, the cavity 60 opens to the fuel intake chamber 32, which facilitates machining of the valve seat 64 in the cavity 60 via the open end thereof, and stabilizes the operation of the fuel pump.

The pressure regulating mechanism 56 is positioned inside the diameter D of the pump chamber 26, does not project from the pump body as shown in FIGS. 1 and 6, and makes the fuel pump compact compared with the pressure regulating mechanism of the related art shown in FIG. 9.

As described so far, the pressure regulating mechanism is positioned inside the outer diameter D of the pump chamber, does not project from the pump body, makes the fuel pump compact, and reduces problems related to fitting of the fuel pump compared with the pressure regulating mechanism of the related art.

Further, the valve seat to be provided in the pump body or cap is positioned in a shallow bottom of the cavity. The cap is separate from the pump body, which facilitates machining of the valve seat, and confirmation of the machined state of the valve seat.

Still further, a fuel return pipe which is necessary in the related art can be dispensed with. This is effective in reducing the cost of the fuel pump and problems related to fitting of the fuel pump.

The pressure regulating mechanism is not linearly positioned with the fuel intake path and fuel discharge path, so that the operation of the valve is not adversely affected, and fuel can flow smoothly.

Finally, the pressure regulating mechanism is perpendicular to the diaphragm, so that a set length of the spring serving as a relief spring can be shortened compared with that of the related art. Therefore, uniform set load is applied to the spring, and the fuel pump can operate stably.

What is claimed is:

1. A diaphragm type fuel pump comprising:

a fuel intake chamber;

a fuel discharge chamber;

a pump body having a fuel intake path communicating with the fuel intake chamber and a fuel discharge path communicating with the fuel discharge chamber;

a diaphragm fixedly attached to the pump body via a bottom body;

a pump chamber defined by the diaphragm and the pump body and communicating with the fuel intake chamber via the fuel intake path and the fuel discharge chamber via the fuel discharge path;

a return path connecting the fuel intake chamber and the fuel discharge chamber; and a pressure regulating mechanism for returning fuel from the fuel discharge chamber to the fuel intake chamber via the return path when pressure in the fuel discharge chamber exceeds a predetermined value, wherein:

the return path is formed in the pump body;

a cavity formed within the pump body and being defined by an inner wall surface of the pump body, the cavity communicating with the return path via a first opening in the cavity and the return path communicating with a first one of a group consisting of the fuel intake chamber and the fuel discharge chamber, the cavity having a second opening communicating with a second one of the group consisting of the fuel intake chamber and the fuel discharge chamber, and the cavity having which is perpendicular to the diaphragm; and the pressure regulating mechanism is housed in the cavity, and is positioned inside an outer diameter of the pump chamber.

2. The fuel pump according to claim 1, wherein:

the pressure regulating mechanism includes a ball valve and a ball valve urging spring;

the first opening of the chamber is formed to open toward the return path which in turn is formed to open toward the fuel intake chamber and the second opening of the cavity is formed to open toward the fuel discharge chamber; and a cap surrounds the second opening of the cavity, is fixedly attached to the inner wall surface of the pump body so that together the cap and the inner wall surface of the pump body define an outer periphery of the cavity, has a path for connecting the second opening of the cavity and the fuel discharge chamber, and defines a valve seat being provided at an inner end of the path in the cap adjacent to the second opening of the cavity and receiving the ball valve of the pressure regulating mechanism.

3. The fuel pump according to claim 1, wherein:

the pressure regulating mechanism includes a ball valve and a ball valve urging spring;

the first opening of the chamber is formed to open toward the return path which in turn is formed to open toward the fuel intake chamber and the second opening of the cavity is formed to open toward the fuel discharge chamber; and a cap is fixedly attached to the inner wall surface of the pump body so that together the cap and the inner wall surface of the pump body define an outer periphery of the cavity, the cap being located opposite the second opening of the cavity;

a path is formed in the pump body and connects the second opening of the cavity and the fuel discharge chamber; and a valve seat is provided at an inner end of the path in the pump body adjacent to the second opening of the cavity and receives the ball valve thereon.

4. The fuel pump according to claim 1, wherein:

the pressure regulating mechanism includes a ball valve and a ball valve urging spring;

the first opening of the chamber is formed to open toward the return path which in turn is formed to open toward the fuel discharge chamber and the second opening of the cavity is formed to open toward the fuel intake chamber;

a cap surrounds the second opening of the cavity and is fixedly attached to the inner wall surface of the pump body so that together the cap and the inner wall surface of the pump body define an outer periphery of the cavity;

a path is formed in the cap and connects the second opening of the cavity and the fuel intake chamber; and a valve seat is provided at the first opening of the cavity at a position where the inner wall surface of the pump body connects to the return path, and receives the ball valve thereon.

5. The fuel pump according to claim 1, wherein:

the pressure regulating mechanism includes a ball valve and a ball valve urging spring;

the cavity is formed to open toward the pump chamber;

the first opening of the chamber is formed to open toward the return path which in turn is formed to open toward the fuel discharge chamber and the second opening of the cavity is formed to open toward the fuel intake chamber;

a cap surrounds the second opening of the cavity and is fixedly attached to the inner wall surface of the pump body so that together the cap and the inner wall surface of the pump body define an outer periphery of the cavity;

a first path is formed in the inner wall surface of the pump body and connects the second opening of the cavity and the fuel intake chamber;

a second path is formed in the cap and connects the first opening of the cavity and the return path; and a valve seat is provided at an inner end of the second path and receives the ball valve thereon.

* * * * *